US006905271B1

(12) United States Patent
Short

(10) Patent No.: US 6,905,271 B1
(45) Date of Patent: Jun. 14, 2005

(54) FINGER-MOUNTED MARKING DEVICE

(76) Inventor: Ronald J. Short, 1196 Foxford Dr., Avon, IN (US) 46123

( * ) Notice: Subject to any disclaimer, the term of this patent is extended or adjusted under 35 U.S.C. 154(b) by 19 days.

(21) Appl. No.: 10/702,876

(22) Filed: Nov. 6, 2003

Related U.S. Application Data

(63) Continuation-in-part of application No. 10/304,942, filed on Nov. 26, 2002, now Pat. No. 6,669,388.

(51) Int. Cl.[7] ..... A46B 5/02
(52) U.S. Cl. ..... 401/8; 401/7; 401/48
(58) Field of Search ..... 401/6–8, 48, 52, 401/195; 15/437, 438, 443, 444

(56) References Cited

U.S. PATENT DOCUMENTS

| | | | |
|---|---|---|---|
| 36,652 | A | 10/1862 | Jacobs |
| 974,887 | A | 11/1910 | Huddle |
| 1,206,976 | A | 12/1916 | Barth |
| 1,681,842 | A | 8/1928 | Collen |
| 3,005,441 | A | 10/1961 | Glasscock |
| 3,402,984 | A | 9/1968 | Zazzara |
| 3,596,964 | A | 8/1971 | Zazzara |
| 3,662,629 | A | 5/1972 | Lance |
| 4,127,338 | A | 11/1978 | Laybourne |
| 4,332,178 | A | 6/1982 | Vukich |
| 4,447,912 | A | 5/1984 | Morrow |
| 4,738,556 | A | 4/1988 | Brown |
| 4,917,517 | A | 4/1990 | Ertz |
| 5,391,010 | A | 2/1995 | Gorbunov |
| 5,405,206 | A | 4/1995 | Bedol |
| 5,529,415 | A | 6/1996 | Bishop |
| 5,542,588 | A | 8/1996 | Sison |
| 5,722,575 | A | 3/1998 | Smith |
| 5,868,509 | A | 2/1999 | Crutcher |
| 5,885,018 | A | 3/1999 | Sato |
| 5,944,433 | A | 8/1999 | O'Mara et al. |
| 5,971,642 | A | 10/1999 | O'Mara et al. |
| D418,494 | S | 1/2000 | Robb |
| D458,933 | S | 6/2002 | Schneider |
| 2001/0007392 | A1 | 7/2001 | Sugarman |

*Primary Examiner*—Tuan Nguyen
(74) *Attorney, Agent, or Firm*—Woodard, Emhardt, Moriarty, McNett & Henry LLP

(57) ABSTRACT

A finger-mounted marking device allowing marking instruments such as a pen or pencil to be worn on a finger, and allowing for hands-free usage without engaging other fingers two rings are coupled to the cylinder for receiving the operator's finger. A cylinder holds a marking instrument, and a set screw holds the marking instrument in place. The marking instrument can be adjusted or replaced based on the desires of the operator. In a second embodiment, a strap is coupled to the cylinder through a strap receiving holder and receives the operator's finger. A latch holds the marking instrument in place by applying pressure and allows the marking instrument to be adjusted or replaced.

20 Claims, 2 Drawing Sheets

FINGER-MOUNTED MARKING DEVICE

CROSS-REFERENCE TO RELATED APPLICATIONS

This application is a continuation-in-part of application Ser. No. 10/304,942, filed Nov. 26, 2002 now U.S. Pat. No. 6,669,388.

TECHNICAL FIELD OF THE INVENTION

The present invention relates to marking instruments and, in particular, to a marking instrument adjustably mounted in a holder and operative to allow hands-free usage.

BACKGROUND OF THE INVENTION

Various types of finger-mounted marking devices are in use today. Some of them are worn on an index, thumb, or other finger. These require the use of other fingers to hold the device while writing. Other marking devices are worn on a finger tip. In such cases, the marking device gets in the way when it is not in use. Many of the current finger-mounted marking devices require special sizes or designs of pens or pencils that are not widely available. Others have writing instruments permanently mounted that cannot be adjusted or replaced.

There is thus a need for a finger-mounted marking device that allows for hands-free use without other fingers, yet that will remain out of the way when not in use. Furthermore, a need exists for a device allowing adjustment of the marking instrument to different positions and for easy replacement with marking instruments that are commonly available.

SUMMARY OF THE INVENTION

One object of the present invention is to provide a finger-mounted marking device that allows hands-free use without gripping the device with other fingers.

Another object is to provide a finger-mounted marking device that allows a pen or pencil to be held in position with respect to the device to be adjusted and held in place.

In one embodiment, the invention comprises a finger-mounted device for a marking instrument such as a pen or pencil to be worn on a finger, such as an index finger. The device comprises a cylinder with two rings coupled to the cylinder. The two rings are designed to accept a finger. The cylinder contains an opening for accepting a set screw and the set screw, when inserted and tightened, secures the marking instrument in place.

In one embodiment of the present invention, a finger-mounted marking device is disclosed comprising: a plurality of rings; a cylinder coupled to the plurality of rings; the plurality of rings being operative to receive a finger; the cylinder being operative to receive a marking instrument; a grooved hole in the cylinder; a set screw for securing the marking instrument in the cylinder through the grooved hole.

In another embodiment of the present invention, a hands-free method of using a finger-mounted marking device is disclosed, the method comprising: having a marking device on top of a finger; and using the marking device to mark without engaging other fingers.

In yet another embodiment of the present invention, a finger-mounted marking device is disclosed comprising: a cylinder; a strap receiving holder coupled to the cylinder, said receiving holder having a curved shape and a plurality of openings; a strap coupled to the receiving holder through the plurality of openings; wherein the strap is operative to receive a single finger; wherein the cylinder is configured to receive a marking instrument; a hole in the cylinder; and a latch for securing the marking instrument in the cylinder by applying pressure to the marking instrument through the hole.

In another embodiment of the present invention, a finger-mounted marking device is disclosed comprising: a cylinder; a strap receiving holder coupled to the cylinder, said receiving holder having a curved shape and a plurality of openings; an adjustable strap, said strap being fixably attached to the strap receiving holder at one of the plurality of openings, and said strap being operative to loop through a second one of the plurality of openings to fasten the strap in place; wherein the strap is operative to receive a single finger and is to be worn at a part of said single finger to allow the marking device to remain thereon and out of the way when not in use so as not to impede the action of said single finger; wherein the cylinder is operative to receive a marking instrument; a hole in the cylinder; a latch for securing the marking instrument in the cylinder by applying pressure to the marking instrument through the hole; and wherein the marking device is operative to mark without engaging the marking device with any fingers other than said single finger.

DETAILED DESCRIPTION OF THE PREFERRED EMBODIMENTS

Figure 1:
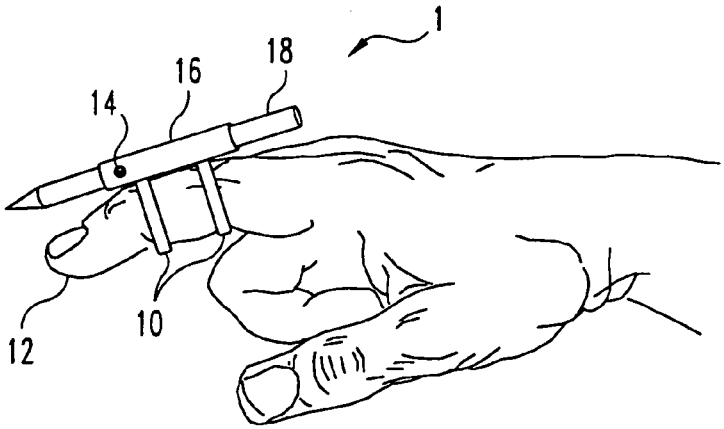
FIG. 1 is a side elevational view of a finger-mounted marking device of a first embodiment in use with a marking instrument and portions of an operator's finger.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

The present invention provides a method and apparatus for a finger-mounted marking device allowing for hands-free use and adjustable/replaceable marking instruments.

Referring to FIGS. 1–4, a finger-mounted marking device 1 is shown. Two rings 10 are coupled to a cylinder 16. The rings and cylinder can be made of a variety of materials, such as metal or plastic, as a few examples. The cylinder can be one of a variety of sizes for fitting various types of marking instruments. The rings can optionally be adjustable in size to fit varying finger sizes, such as being made of nylon straps with Velcro® fasteners, as one non-limiting example. In an alternate embodiment, there may be just a single ring with a wider band, such as a single ring spanning the distance between the two rings 10 on FIG. 1.

In a first embodiment, the rings 10 receive a finger 12 of the operator. The finger 12 is preferably, but not necessarily, an index finger. A marking instrument 18 is inserted into the cylinder 16 and secured with a set mechanism, such as set screw 14. The marking instrument can be a pen, a pencil, or a piece of chalk, to name a few examples.

The rings 10 along with the set screw 14 of the cylinder 16 securely hold the marking instrument 18 in place against the operator's finger so that he can use the device without gripping the device with other fingers. This hands-free use of the marking device without having to engage other fingers enables the operator to continue using the other fingers for a different purpose while writing with the marking device. For example, an operator who is holding a tape measure can make a mark without letting go of the tape measure.

Figure 2:
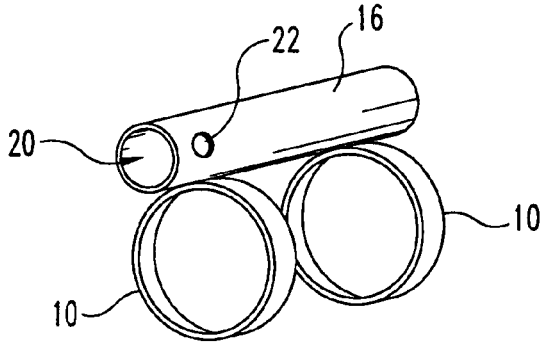
FIG. 2 is a perspective view of a marking device of a first embodiment without the marking instrument.
Figure 3:
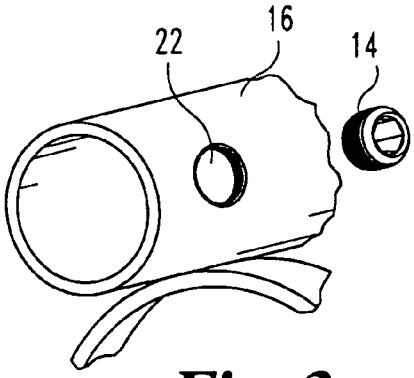
FIG. 3 is a partial perspective view showing the grooves of a first embodiment of the cylinder where the set screw is inserted.

As shown in FIGS. 2 and 3, the cylinder 16 preferably contains grooves 22 for accepting a set screw to secure a marking instrument 18 that was inserted into the inner cavity 20 of the cylinder 16.

Figure 4:
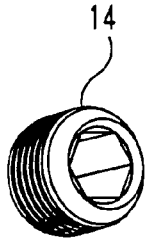
FIG. 4 shows an example of a first embodiment set screw that can be inserted into the cylinder to secure the marking instrument.

A set screw, such as the one shown in FIG. 4, when inserted into the grooves 22 of the cylinder 16 will securely hold a marking instrument in place. This set screw can be made of many different materials, such as metal or plastic. Furthermore, in a preferred embodiment, the set screw is of the type that is adjusted with a hex key. In another embodiment, the set screw can be a thumb screw that is adjusted by the operator's fingers. Other types of set screws as familiar to those skilled in the art can also be used.

Returning to FIG. 1, the set screw 14 allows a marking instrument 18 to be adjusted to varying positions based on the desires of the operator. Furthermore, the set screw allows for easy removal of the marking instrument so that it can be replaced as desired. Marking instruments of varying types and lengths can be used and thus replacements are commonly available.

Figure 5:
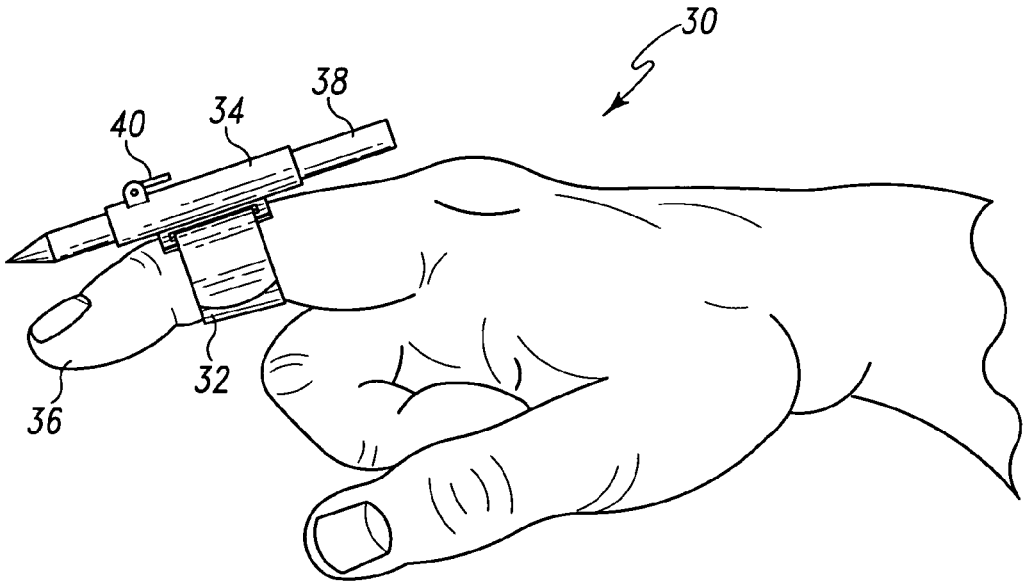
FIG. 5 shows a side elevational view of a finger-mounted marking device of a second embodiment in use with a marking instrument and portions of an operator's finger.
Figure 6:
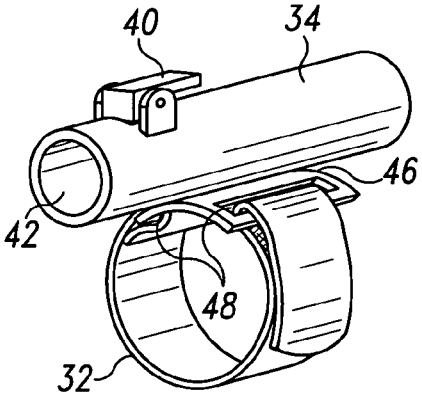
FIG. 6 is a perspective view of a marking device of a second embodiment without a marking instrument.
Figure 7:
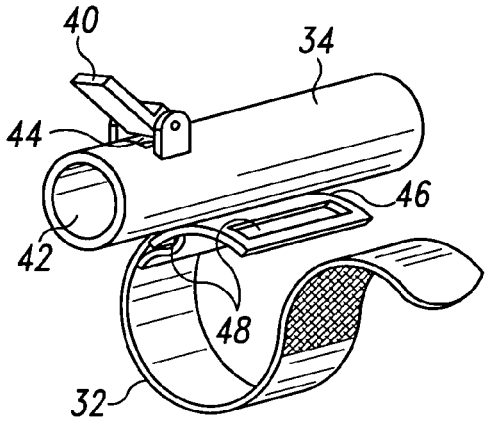
FIG. 7 is a perspective view of a marking device of a second embodiment illustrating how a strap and latch can be adjusted.

Referring to FIGS. 5–7, in a second preferred embodiment finger-mounted marking device 30 is shown. A strap 32 is coupled to a cylinder 34. The strap and cylinder can be made of a variety of materials, such as metal, plastic, or nylon, as a few non-limiting examples. The cylinder can be one of a variety of sizes for fitting various types of marking instruments. In one embodiment, the strap can be adjusted in size to fit varying finger sizes, such as being made of nylon straps with Velcro® fasteners, as one non-limiting example.

The strap 32 receives a finger 36 of the operator. The finger 36 is preferably, but not necessarily, an index finger. A marking instrument 38 is inserted into the cylinder 34 and secured with a latch 40. The marking instrument can be a pen, a pencil, or a piece of chalk, to name a few examples.

The strap 32 along with the latch 40 of the cylinder 34 securely hold the marking instrument 38 in place against the operator's finger so that the can use the device without gripping the device with other fingers. This hands-free use of the marking device without having to engage other fingers enables the operator to continue using the other fingers for a different purpose while writing with the marking device. As described in the first embodiment, one example is an operator who is holding a tape measure can make a mark without letting go of the tape measure.

As shown in FIGS. 6 and 7, the cylinder 34 preferably contains a hole 44 or other opening for allowing pressure to be applied from latch 40 directly to a marking instrument 38 that was inserted into the inner cavity 42 of the cylinder 34, thereby securing the marking instrument 38 in place. For example, latch 40 can have a nub that goes through hole 44 that contacts and puts pressure on marking instrument 38. Latch 40 can be made of many different materials, such as metal or plastic. Latch 40 can be secured to cylinder 34 in a variety of ways, such as using a pin or a rod, to name a few examples. Other types of latches as familiar to those skilled in the art can also be used.

As shown in FIGS. 6 and 7, strap 32 is coupled to cylinder 34 through strap receiving holder 46, which has a plurality of openings 48. Strap receiving holder 46 is preferably curved so as to fit partially around an operator's finger comfortably and/or securely. Preferably, strap 32 is an adjustable strap, such as nylon or another material, and can be looped or threaded through openings 48 to adjust the strap diameter to best fit the operator's finger 36. Adjustable strap of strap 32 is preferably securely fixed to one of the openings 48 and can be looped over and around a second opening 48 so as to fasten the strap in place with a fastener such as one made of Velcro® fasteners. Other variations for providing an adjustible strap are possible, as would occur to one of ordinary skill in the art.

Returning to FIG. 5, latch 40 allows a marking instrument 38 to be adjusted to varying positions based on the desires of the operator. Furthermore, the latch allows for easy removal of the marking instrument so that it can be replaced as desired. Marking instruments of varying types and lengths can be used and thus replacements are commonly available.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A finger-mounted marking device comprising:

a cylinder;

a strap receiving holder coupled to the cylinder, said receiving holder having a curved shape and a plurality of openings;

a strap coupled to the receiving holder through the plurality of openings;

wherein the strap is operative to receive a single finger;

wherein the cylinder is configured to receive a marking instrument;

a hole in the cylinder; and a latch for securing the marking instrument in the cylinder by applying pressure to the marking instrument through the hole.

2. The device of claim 1, wherein the strap is adjustable and is fixably attached to the strap receiving holder at one of the plurality of openings, and said strap being operative to be threaded through a second one of the plurality of openings to fasten the strap in place.

3. The device of claim 1, wherein the marking device is operative to mark without engaging the marking device with any fingers other than said single finger.

4. The device of claim 1, wherein said strap is to be worn at a part of said single finger to allow the marking device to remain thereon and out of the way when not in use so as not to impede the action of said single finger.

5. The device of claim 1, wherein the single finger is an index finger.

6. The device of claim 1, wherein the marking instrument is a pen.

7. The device of claim 1, wherein the marking instrument is a pencil.

8. The device of claim 1, wherein the marking instrument is chalk.

9. The device of claim 1, wherein the cylinder is made out of metal.

10. The device of claim 1, wherein the cylinder is made out of plastic.

11. The device of claim 1, wherein the strap is made out of nylon with a fastener.

12. The device of claim 1, wherein the strap is adjustable in size.

13. A finger-mounted marking device comprising:

a cylinder;

a strap receiving holder coupled to the cylinder, said receiving holder having a curved shape and a plurality of openings;

an adjustable strap, said strap being fixably attached to the strap receiving holder at one of the plurality of openings, and said strap being operative to loop through a second one of the plurality of openings to fasten the strap in place;

wherein the strap is operative to receive a single finger and is to be worn at a part of said single finger to allow the marking device to remain thereon and out of the way when not in use so as not to impede the action of said single finger;

wherein the cylinder is operative to receive a marking instrument;

a hole in the cylinder;

a latch for securing the marking instrument in the cylinder by applying pressure to the marking instrument through the hole; and wherein the marking device is operative to mark without engaging the marking device with any fingers other than said single finger.

14. The device of claim 13, wherein the adjustable strap is made out of nylon.

15. The device of claim 13, wherein the single finger is an index finger.

16. The device of claim 13, wherein the marking instrument is a pen.

17. The device of claim 13, wherein the marking instrument is a pencil.

18. The device of claim 13, wherein the marking instrument is chalk.

19. The device of claim 13, wherein the cylinder is made out of metal.

20. The device of claim 13, wherein the cylinder is made out of plastic.

* * * * *